US009818324B2

(12) United States Patent
Kawaguchi et al.

(10) Patent No.: US 9,818,324 B2
(45) Date of Patent: Nov. 14, 2017

(54) TRANSMISSION DEVICE, DISPLAY DEVICE, AND DISPLAY SYSTEM

(71) Applicant: Panasonic Liquid Crystal Display Co., Ltd., Hyogo (JP)

(72) Inventors: Seiji Kawaguchi, Hyogo (JP); Tatsuo Itoman, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 25 days.

(21) Appl. No.: 15/062,200

(22) Filed: Mar. 7, 2016

(65) Prior Publication Data

US 2017/0256189 A1 Sep. 7, 2017

(51) Int. Cl.
*G09G 5/10* (2006.01)
*G09G 3/18* (2006.01)

(52) U.S. Cl.
CPC ..... *G09G 3/18* (2013.01); *G09G 2340/00* (2013.01)

(58) Field of Classification Search
USPC ..... 345/531
See application file for complete search history.

(56) References Cited

U.S. PATENT DOCUMENTS

2005/0162367 A1* 7/2005 Kobayashi ..... G09G 3/3648 345/98
2006/0103682 A1* 5/2006 Kunimori ..... G09G 3/3611 345/690
2009/0128525 A1* 5/2009 Kotani ..... G09G 3/3614 345/204
2014/0055473 A1* 2/2014 Kikuchi ..... G09G 5/022 345/531

FOREIGN PATENT DOCUMENTS

JP 2014-044322 A 3/2014

* cited by examiner

*Primary Examiner* — Roy Rabindranath
(74) *Attorney, Agent, or Firm* — Hubbs, Enatsky & Inoue PLLC

(57) ABSTRACT

Provided is a display system, including: a display device configured to display an image; and a transmission device configured to simultaneously transmit, to the display device, first image data of a first frame and second image data of a second frame that is one frame before the first frame, the display device including: an overdrive processing unit configured to receive the first image data and the second image data transmitted from the transmission device, and to execute overdrive processing on the first image data based on the received first image data and the received second image data, to thereby generate display data; and a display panel configured to display an image based on the display data generated by the overdrive processing unit.

7 Claims, 6 Drawing Sheets

TRANSMISSION DEVICE, DISPLAY DEVICE, AND DISPLAY SYSTEM

BACKGROUND

1. Technical Field

The present application relates to a transmission device, a display device, and a display system.

2. Description of the Related Art

Hitherto, overdrive processing has been proposed as one of technologies for improving the display performance of a liquid crystal display device. The overdrive processing is a technology of setting, at a rise time, a drive voltage for driving liquid crystal to be higher than an original drive voltage corresponding to a grayscale to be displayed, and setting, at a fall time, the drive voltage to be lower than the original drive voltage, to thereby increase the response speed of the liquid crystal.

In general, the overdrive processing requires a memory configured to store image data of one frame before (previous frame). As a result, the configuration of an overdrive circuit becomes complicated, and the cost of the display device is increased. As a technology for solving this problem, for example, in Japanese Patent Application Laid-open No. 2014-44322, there is disclosed a technology of restricting the image data to be stored in the memory to image data of a specific color or image data in a specific region, to thereby reduce the capacity of the memory.

SUMMARY

However, in the related art, even if the memory for overdrive installed on a timing controller is reduced in capacity, the frame memory itself is necessary, and hence it cannot be said that the above-mentioned problem is fully solved.

The present application has been made in view of the above-mentioned problem, and has an object to simplify the configuration of the overdrive circuit and reduce the cost of the display device.

In order to solve the above-mentioned problem, according to one embodiment of the present application, there is provided a display system, including: a display device configured to display an image; and a transmission device configured to simultaneously transmit, to the display device, first image data of a first frame and second image data of a second frame that is one frame before the first frame. The display device includes: an overdrive processing unit configured to receive the first image data and the second image data transmitted from the transmission device, and to execute overdrive processing on the first image data based on the received first image data and the received second image data, to thereby generate display data; and a display panel configured to display an image based on the display data generated by the overdrive processing unit.

In the display system according to the one embodiment of the present application, the transmission device may be configured to generate overdrive image data of (A+B) bits such that the second image data is allocated to A bits and the first image data is allocated to B bits, to thereby transmit the generated overdrive image data to the display device. In the display system, the overdrive processing unit may be configured to execute the overdrive processing on the first image data based on the second image data and the first image data.

In the display system according to the one embodiment of the present application, the transmission device may be configured to: transmit, for a region having low grayscale characteristics, the overdrive image data of (A+B) bits to the display device; and transmit, for a region having high grayscale characteristics, the first image data of (A+B) bits to the display device.

In the display system according to the one embodiment of the present application, the display panel may include an in-vehicle panel installed on a vehicle, and the overdrive image data may correspond to an instrument cluster image of the in-vehicle panel.

In the display system according to the one embodiment of the present application, the transmission device may be configured to: transmit, for a region of the instrument cluster image, the overdrive image data of (A+B) bits to the display device; and transmit, for a region other than the region of the instrument cluster image, the first image data of (A+B) bits to the display device.

In the display system according to the one embodiment of the present application, the overdrive image data of (A+B) bits may be set to satisfy A<B.

In the display system according to the one embodiment of the present application, the transmission device may further include a specifying unit configured to specify an overdrive region. In the display system, the transmission device may be configured to: transmit, for the overdrive region specified by the specifying unit, the first image data and the second image data simultaneously to the display device; and transmit, for a region other than the overdrive region, the first image data to the display device.

In the display system according to the one embodiment of the present application, the transmission device may further include a first transmission interface and a second transmission interface. In the display system, the display device may further include a first receiving interface and a second receiving interface. The display system may further include a first transmission line configured to connect the first transmission interface and the first receiving interface to each other, and a second transmission line configured to connect the second transmission interface and the second receiving interface to each other. The transmission device may be configured to transmit the first image data to the display device via the first transmission line, and to transmit the second image data to the display device via the second transmission line.

Further, in order to solve the above-mentioned problem, according to one embodiment of the present application, there is provided a display system, including: a display device configured to display an image; and a transmission device configured to transmit, to the display device, first image data of a first frame and second image data of a second frame that is one frame before the first frame. The display device includes: an overdrive processing unit configured to receive the first image data and the second image data transmitted from the transmission device, and to execute overdrive processing on the first image data based on the received first image data and the received second image data, to thereby generate display data; and a display panel configured to display an image based on the display data generated by the overdrive processing unit. The transmission device further includes a first transmission interface. The display device further includes a first receiving interface. The display system further includes a first transmission line configured to connect the first transmission interface and the first receiving interface to each other. The transmission device is configured to, when the overdrive processing is not executed, transmit the first image data to the display device via the first transmission line at a first transfer speed, and when the overdrive processing is executed, transmit the first image data and the second image data to the display device via the first transmission line at a transfer speed twice as high as the first transfer speed.

Further, in order to solve the above-mentioned problem, according to one embodiment of the present application, there is provided a transmission device, which is configured to transmit image data to a display device, the transmission device being configured to simultaneously transmit, to the display device, first image data of a first frame and second image data of a second frame that is one frame before the first frame.

The transmission device according to the one embodiment of the present application may be configured to generate overdrive image data of (A+B) bits such that the second image data is allocated to A bits and the first image data is allocated to B bits, to thereby transmit the generated overdrive image data to the display device.

The transmission device according to the one embodiment of the present application may be configured to: transmit, for a region having low grayscale characteristics, the overdrive image data of (A+B) bits to the display device; and transmit, for a region having high grayscale characteristics, the first image data of (A+B) bits to the display device.

In the transmission device according to the one embodiment of the present application, the overdrive image data of (A+B) bits may be set to satisfy A<B.

DETAILED DESCRIPTION

Figure 1:
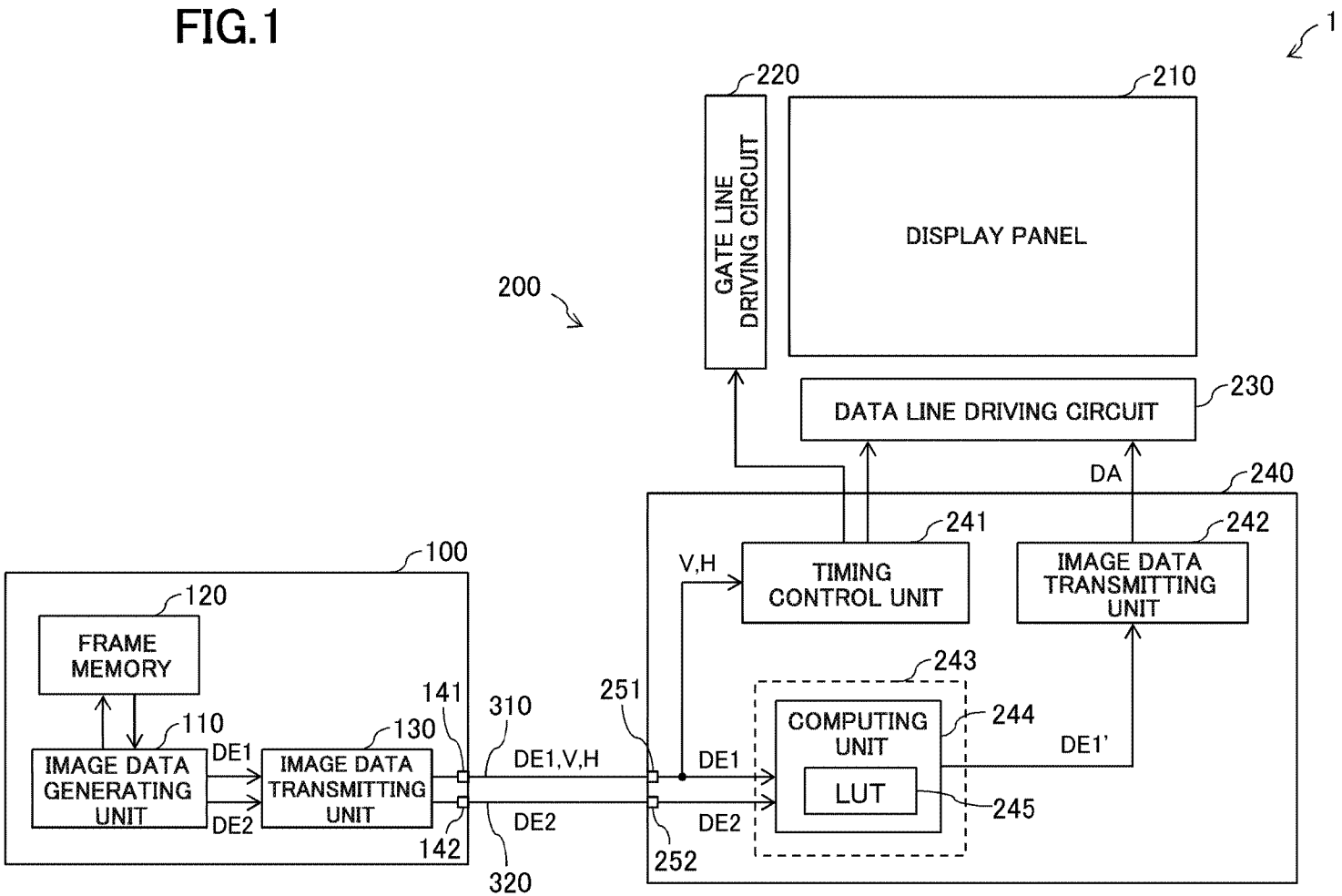
FIG. 1 is a block diagram for illustrating a functional configuration of a display system according to an embodiment of the present application.

An embodiment of the present application is described below with reference to the drawings. FIG. 1 is a block diagram for illustrating a functional configuration of a display system according to this embodiment. A display system 1 includes a transmission device 100 and a liquid crystal display device 200.

The transmission device 100 is configured to generate image data corresponding to an image to be displayed on the liquid crystal display device 200, to thereby transmit the generated image data to the liquid crystal display device 200. For example, when the liquid crystal display device 200 is installed on a vehicle, the transmission device 100 generates image data corresponding to an instrument cluster image or a map image, to thereby transmit the generated image data to the liquid crystal display device 200. The image data is made up of, for example, 8 bits per pixel. For example, each of image data of an R pixel displaying a red color, image data of a G pixel displaying a green color, and image data of a B pixel displaying a blue color is made up of 8 bits. The image data of each pixel is also referred to as "pixel data".

The transmission device 100 includes an image data generating unit 110, a frame memory 120, and an image data transmitting unit 130. The image data generating unit 110 is configured to generate image data of 8 bits so as to correspond to each pixel, to thereby write the image data for one frame to the frame memory 120. Further, the image data generating unit 110 is configured to read the image data of one frame before (hereinafter referred as "previous frame data") from the frame memory 120. Further, the image data generating unit 110 is configured to output the generated image data of the current frame (current frame data DE1) and previous frame data DE2 read from the frame memory 120 to the image data transmitting unit 130. The image data transmitting unit 130 is configured to transmit the current frame data DE1, the previous frame data DE2, a vertical synchronizing signal VSYNC, and a horizontal synchronizing signal HSYNC to the liquid crystal display device 200.

The transmission device 100 further includes a first transmission interface 141 and a second transmission interface 142. The image data transmitting unit 130 is configured to transmit the current frame data DE1 to the liquid crystal display device 200 via a first transmission line 310 connected to the first transmission interface 141, and to transmit the previous frame data DE2 to the liquid crystal display device 200 via a second transmission line 320 connected to the second transmission interface 142.

Further, the image data transmitting unit 130 is configured to transmit the current frame data DE1 and the previous frame data DE2 to the liquid crystal display device 200 in synchronization with each other. For example, the image data transmitting unit 130 is configured to transmit the current frame data DE1 and the previous frame data DE2 to the liquid crystal display device 200 at the same time (same timing). Note that, the same time as used herein specifically refers to times within one horizontal scanning period (1H). That is, the image data transmitting unit 130 is configured to transmit the current frame data DE1 and the previous frame data DE2 to the liquid crystal display device 200 within the same one horizontal scanning period (1H).

The liquid crystal display device 200 includes a display panel 210, a gate line driving circuit 220, a data line driving circuit 230, a timing controller 240, and a backlight device (not shown).

Figure 2:
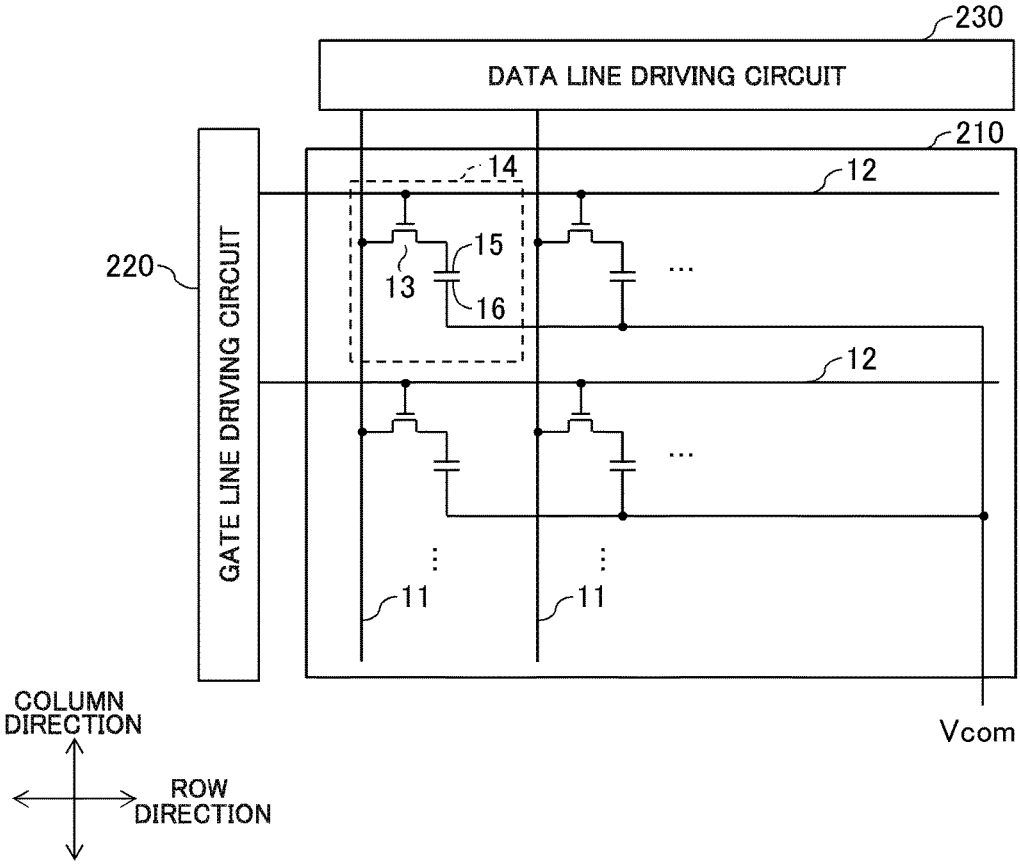
FIG. 2 is a plan view for illustrating a schematic configuration of a display panel according to the embodiment.

FIG. 2 is a plan view for illustrating a schematic configuration of the display panel 210. The display panel 210 includes a plurality of data lines 11 extending in a column direction, and a plurality of gate lines 12 extending in a row direction. A thin film transistor 13 (TFT) is formed at each intersecting portion between each data line 11 and each gate line 12. Each data line 11 is connected to the data line driving circuit 230. Each gate line 12 is connected to the gate line driving circuit 220.

Further, the display panel 210 includes a plurality of pixels 14 arranged in matrix (row direction and column direction) so as to correspond to the respective intersecting portions between the data lines 11 and the gate lines 12. Note that, although not shown, the display panel 210 includes a thin film transistor substrate (TFT substrate), a color filter substrate (CF substrate), and a liquid crystal layer sandwiched between both the substrates. The TFT substrate has a plurality of pixel electrodes 15 formed thereon so as to correspond to the respective pixels 14. The CF substrate has a common electrode 16 formed thereon, which is shared by the respective pixels 14. Note that, the common electrode 16 may be formed on the TFT substrate.

Each data line 11 is supplied with a data signal (data voltage) from the data line driving circuit 230. Each gate line 12 is supplied with a gate signal (gate voltage) from the gate line driving circuit 220. The common electrode 16 is supplied with a common voltage Vcom. When an on voltage of the gate signal is supplied to the gate line 12, the thin film transistor 13 connected to the gate line 12 is turned on, and the data voltage is supplied to the pixel electrode 15 via the data line 11 connected to the thin film transistor 13. An electric field is generated by the difference between the data voltage supplied to the pixel electrode 15 and the common voltage Vcom supplied to the common electrode 16. Liquid crystal is driven by this electric field to control the transmittance of light from the backlight device, to thereby display an image. Note that, when color display is performed, the color display is realized by supplying a desired data voltage to each data line 11 connected to the pixel electrode 15 of each of the pixels 14 corresponding to the red color, the green color, and the blue color formed by vertical-stripe color filters.

The timing controller 240 is configured to generate display data DA for image display, and a plurality of timing signals for defining operation timings of the gate line driving circuit 220 and the data line driving circuit 230. The timing controller 240 includes a timing control unit 241, an image data transmitting unit 242, and an overdrive processing unit 243.

The timing control unit 241 is configured to generate a plurality of timing signals including a polarity control signal, a data start pulse, a data clock, a gate start pulse, and a gate clock based on the vertical synchronizing signal VSYNC, the horizontal synchronizing signal HSYNC, and other signals that are transmitted from the transmission device 100. The timing control unit 241 is configured to supply the generated plurality of timing signals to the data line driving circuit 230 and the gate line driving circuit 220, to thereby control the operation timings of the data line driving circuit 230 and the gate line driving circuit 220. A known configuration can be applied to the timing control unit 241.

The overdrive processing unit 243 includes a computing unit 244, and the computing unit 244 includes a look-up table (LUT) 245. The overdrive processing unit 243 is configured to receive the current frame data DE1 transmitted from the transmission device 100 via the first transmission line 310 connected to a first receiving interface 251, and receive the previous frame data DE2 transmitted from the transmission device 100 via the second transmission line 320 connected to a second receiving interface 252. The overdrive processing unit 243 is configured to execute overdrive processing with reference to the LUT 245 based on the current frame data DE1 and the previous frame data DE2 that are received from the transmission device 100. Note that, the LUT 245 may be provided outside of the timing controller 240.

The computing unit 244 is configured to calculate a correction amount for emphatically correcting a grayscale (input grayscale) corresponding to the current frame data DE1 based on the current frame data DE1 and the previous frame data DE2. For example, the computing unit 244 is configured to calculate the above-mentioned correction amount with reference to the LUT 245. The computing unit 244 may be configured to calculate the above-mentioned correction amount with use of an arithmetic expression. The LUT 245 is configured to store correction amounts set in advance so as to correspond to combinations between the input grayscale of the current frame data DE1 and the input grayscale of the previous frame data DE2. The above-mentioned correction amount is set to such a value as to increase the change amount from the input grayscale of the previous frame to the input grayscale of the current frame. Note that, the input grayscale of the image data is a grayscale corresponding to a target to be originally displayed (target grayscale).

The overdrive processing unit 243 is configured to correct the input grayscale of the current frame data DE1 input to the overdrive processing unit 243 based on the correction amount calculated by the computing unit 244. The overdrive processing unit 243 is configured to output the current frame data DE1 whose input grayscale is corrected to the image data transmitting unit 242 as a corrected frame data DE1'. For example, the overdrive processing unit 243 is configured to add the correction amount calculated by the computing unit 244 to the input grayscale corresponding to the current frame data DE1. The grayscale obtained by the adding is referred to as "corrected grayscale". The corrected frame data DE1' corresponding to the corrected grayscale is input to the image data transmitting unit 242. The image data transmitting unit 242 is configured to transmit the corrected frame data DE1' to the data line driving circuit 230 as the display data DA based on the timing signal generated by the timing control unit 241. The timing controller 240 may be configured to execute other known image processing. The display data DA is data subjected to various image processing including the above-mentioned overdrive processing.

The data line driving circuit 230 is configured to supply the data signal (data voltage) to the data line 11 based on the above-mentioned timing signal and display data DA output from the timing controller 240. The gate line driving circuit 220 is configured to supply the gate signal (gate voltage) to the gate line 12 based on the above-mentioned timing signal output from the timing controller 240. With this, an image corresponding to the corrected grayscale is displayed on the display panel 210.

With the above-mentioned configuration, the transmission device 100 transmits the current frame data DE1 and the previous frame data DE2 in synchronization with each other, and the timing controller 240 executes the overdrive processing based on the received current frame data DE1 and the received previous frame data DE2. Therefore, the timing controller 240 does not require a frame memory for overdrive processing. Therefore, the configuration of the overdrive processing unit 243 can be simplified, and the cost of the liquid crystal display device 200 can be reduced.

Figure 3:
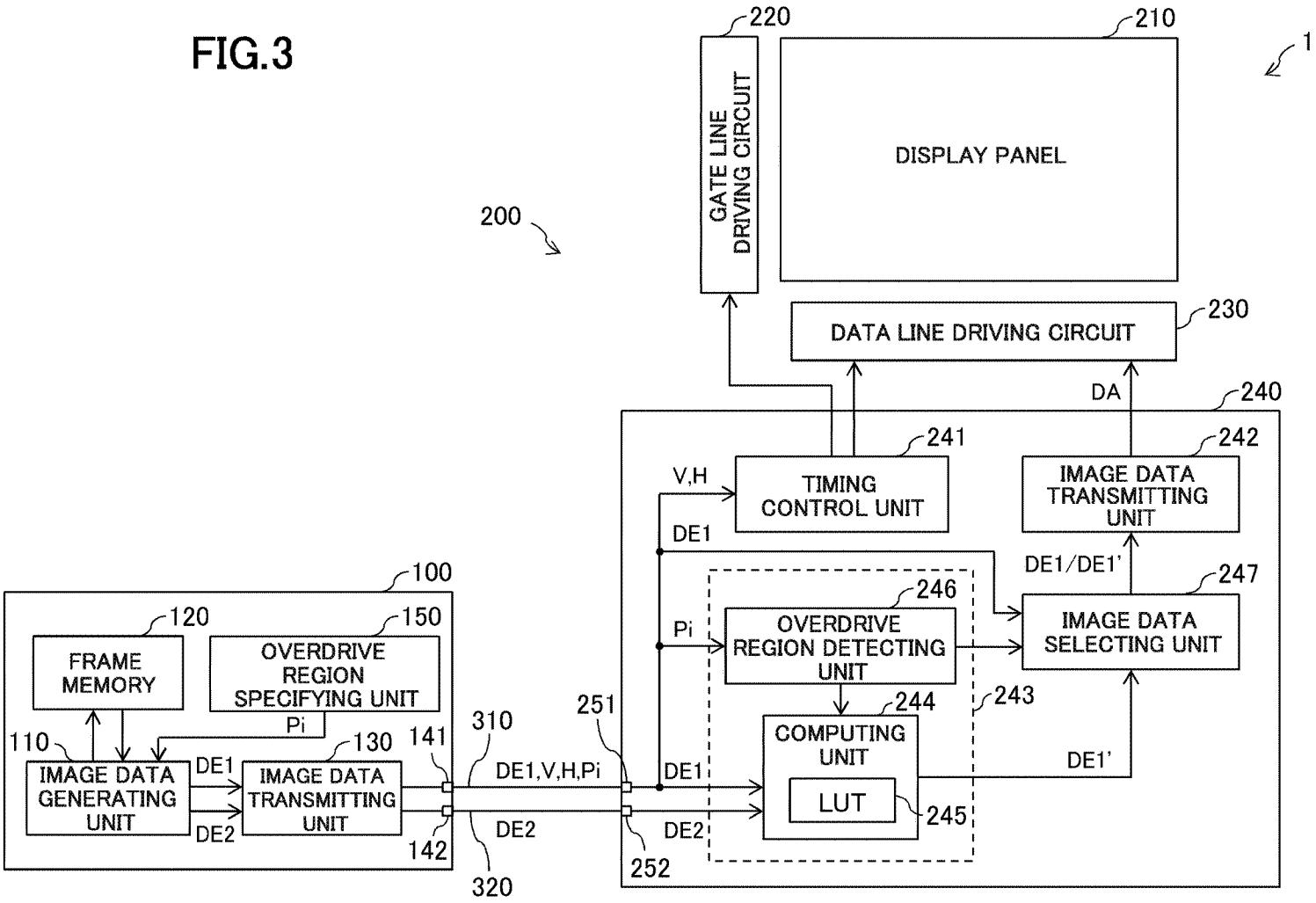
FIG. 3 is a block diagram for illustrating another functional configuration of the display system according to the embodiment.

The display system 1 according to this embodiment may execute the overdrive processing for a predetermined region in the display region. For example, the overdrive processing may be executed only for a region of an instrument cluster image such as a speedometer in the display panel (in-vehicle panel) installed on the vehicle. FIG. 3 is a block diagram for illustrating the functional configuration of the display system 1 having the above-mentioned configuration. As illustrated in FIG. 3, the transmission device 100 further includes an overdrive region specifying unit 150 in addition to the configuration illustrated in FIG. 1, and the timing controller 240 further includes an overdrive region detecting unit 246 and an image data selecting unit 247 in addition to the configuration illustrated in FIG. 1.

The overdrive region specifying unit 150 is configured to specify the region on which the overdrive processing is executed (overdrive region) in the display region. For example, in the display panel 210 (in-vehicle panel) illustrated in FIG. 4, the overdrive region specifying unit 150 specifies regions of meter needles of a speedometer and a tachometer as the overdrive region, and outputs coordinate information Pi representing the overdrive region to the image data generating unit 110. The overdrive region specifying unit 150 may specify a predetermined region as the overdrive region, or may specify a different region for each frame as the overdrive region.

When the image data generating unit 110 acquires the coordinate information Pi from the overdrive region specifying unit 150, the image data generating unit 110 embeds the coordinate information Pi in a vertical blanking period of the image data (current frame data) of the region corresponding to the coordinate information Pi (overdrive region). Note that, the image data generating unit 110 may embed a predetermined flag in the above-mentioned vertical blanking period. The image data generating unit 110 is configured to output the current frame data DE1 including the coordinate information Pi, and the previous frame data DE2 to the image data transmitting unit 130.

The image data transmitting unit 130 is configured to transmit the current frame data DE1 including the coordinate information Pi, the previous frame data DE2, the vertical synchronizing signal VSYNC, and the horizontal synchronizing signal HSYNC to the timing controller 240.

The overdrive processing unit 243 is configured to receive the current frame data DE1 including the coordinate information Pi, and the previous frame data DE2. The overdrive region detecting unit 246 is configured to detect the coordinate information Pi of the image data (current frame data DE1) received by the overdrive processing unit 243. The overdrive region detecting unit 246 is configured to detect the coordinate information Pi, to thereby output the detection result to the computing unit 244 and the image data selecting unit 247. When the computing unit 244 acquires the coordinate information Pi from the overdrive region detecting unit 246, the computing unit 244 executes the overdrive processing on the region corresponding to the coordinate information Pi (overdrive region) based on the current frame data DE1 and the previous frame data DE2. The computing unit 244 is configured to output the corrected frame data DE1' subjected to the overdrive processing to the image data selecting unit 247.

The image data selecting unit 247 is configured to receive the current frame data DE1 transmitted from the transmission device 100, the detection result output from the overdrive region detecting unit 246, and the corrected frame data DE1' output from the computing unit 244. Further, the image data selecting unit 247 is configured to select the corrected frame data DE1' for the region corresponding to the coordinate information Pi (overdrive region) to output the corrected frame data DE1' to the image data transmitting unit 242, and select the current frame data DE1 for a region other than the region corresponding to the coordinate information Pi to output the current frame data DE1 to the image data transmitting unit 242. The image data transmitting unit 242 is configured to transmit the corrected frame data DE1' or the current frame data DE1 to the data line driving circuit 230 as the display data DA based on the timing signal generated by the timing control unit 241.

With the above-mentioned configuration, the overdrive processing is executed for only a predetermined region of the display region, and hence power consumption of the liquid crystal display device 200 can be suppressed.

Figure 5:
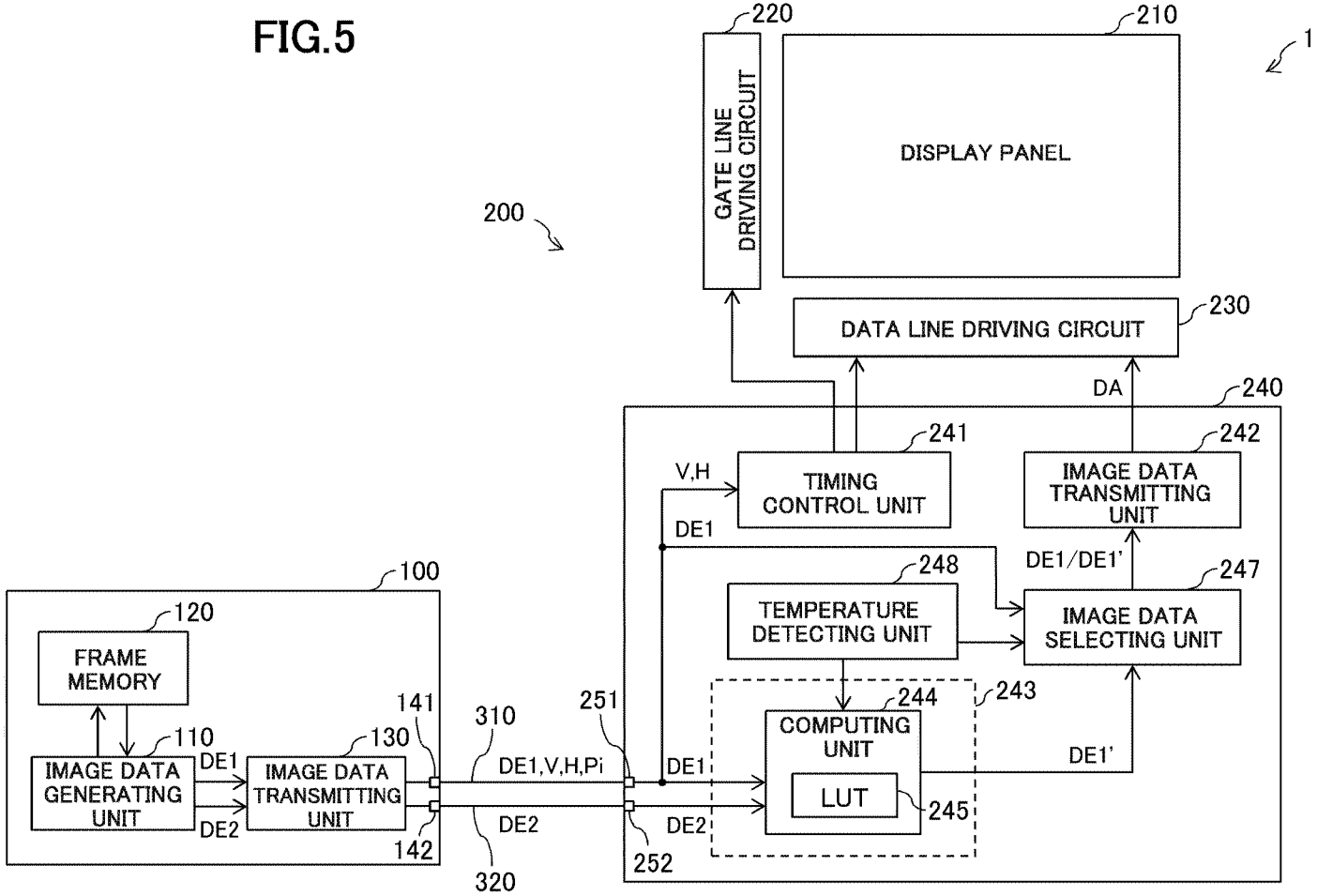
FIG. 5 is a block diagram for illustrating another functional configuration of the display system according to the embodiment.

Further, the display system 1 according to this embodiment may execute the overdrive processing depending on the temperature of the display panel 210. For example, the overdrive processing may be executed when the temperature of the display panel (in-vehicle panel) installed on the vehicle is lower than a predetermined temperature. FIG. 5 is a block diagram for illustrating the functional configuration of the display system 1 having the above-mentioned configuration. In the display system illustrated in FIG. 5, the timing controller 240 further includes a temperature detecting unit 248 and the image data selecting unit 247 in addition to the configuration illustrated in FIG. 1.

The image data transmitting unit 130 illustrated in FIG. 5 is configured to, similarly to the configuration of FIG. 1, transmit the current frame data DE1, the previous frame data DE2, the vertical synchronizing signal VSYNC, and the horizontal synchronizing signal HSYNC to the timing controller 240.

The temperature detecting unit 248 is configured to detect the temperature of the display panel 210, to thereby determine whether or not the temperature is lower than a predetermined temperature. The temperature detecting unit 248 is configured to output the determination result to the overdrive processing unit 243 and the image data selecting unit 247. When the detected temperature is lower than the predetermined temperature, the computing unit 244 executes the overdrive processing based on the current frame data DE1 and the previous frame data DE2. The computing unit 244 is configured to output the corrected frame data DE1' subjected to the overdrive processing to the image data selecting unit 247.

The image data selecting unit 247 is configured to receive the current frame data DE1 transmitted from the transmission device 100, the determination result output from the temperature detecting unit 248, and the corrected frame data DE1' output from the computing unit 244. Then, when the detected temperature is lower than the predetermined temperature, the image data selecting unit 247 selects the corrected frame data DE1' to output the corrected frame data DE1' to the image data transmitting unit 242. When the detected temperature is larger than the predetermined temperature, the image data selecting unit 247 selects the current frame data DE1 to output the current frame data DE1 to the image data transmitting unit 242. The image data transmitting unit 242 is configured to transmit the corrected frame data DE1' or the current frame data DE1 to the data line driving circuit 230 as the display data DA based on the timing signal generated by the timing control unit 241.

With the above-mentioned configuration, reduction in display quality due to reduction in temperature of the display panel 210 can be suppressed. Note that, the temperature detecting unit 248 illustrated in FIG. 5 can also be applied to the display system 1 illustrated in FIG. 3. Note that, the computing unit 244 may include a plurality of LUTs to execute the overdrive processing while switching the LUTs in accordance with the detected temperature.

In the display system 1 illustrated in each of FIG. 1, FIG. 3, and FIG. 5, the transmission device 100 simultaneously transmits the current frame data DE1 and the previous frame data DE2, but the transmission device 100 according to this embodiment is not limited thereto. For example, when the data transfer speed in a general display device that does not execute the overdrive processing is assumed to be a first transfer speed, the transmission device 100 may transmit the current frame data DE1 and the previous frame data DE2 to the timing controller 240 via the first transmission line 310 at a speed twice as high as the first transfer speed (second transfer speed). In this case, the second transmission interface 142, the second transmission line 320, and the second receiving interface 252 are unnecessary. Further, when the overdrive processing is not executed, the transmission device 100 may transmit the current frame data DE1 to the timing controller 240 via the first transmission line 310 at the first transfer speed, and when the overdrive processing is executed, the transmission device 100 may transmit the current frame data DE1 and the previous frame data DE2 to the timing controller 240 via the first transmission line 310 at the second transfer speed.

Figure 6:
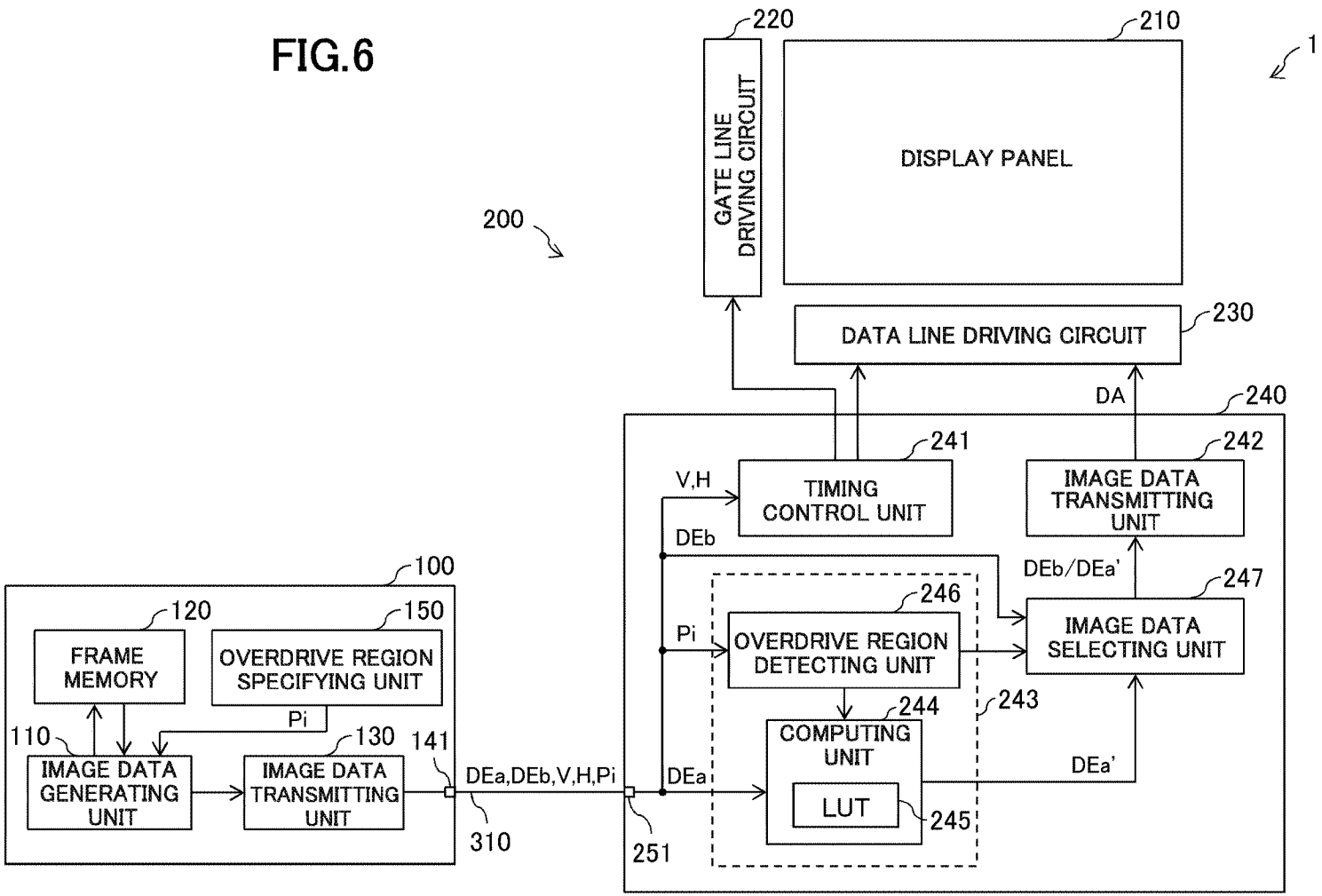
FIG. 6 is a block diagram for illustrating another functional configuration of the display system according to the embodiment.

Further, in the display system 1 illustrated in each of FIG. 1, FIG. 3, and FIG. 5, the current frame data and the previous frame data are each made up of 8 bits, but the display system 1 according to this embodiment is not limited thereto. For example, in the frame data to which the overdrive processing is executed, the previous frame data may be allocated to the upper 4 bits of the 8 bits, and the current frame data may be allocated to the lower 4 bits thereof. FIG. 6 is a block diagram for illustrating the functional configuration of the display system 1 having the above-mentioned configuration. As illustrated in FIG. 6, the transmission device 100 further includes the overdrive region specifying unit 150 in addition to the configuration illustrated in FIG. 1, and the timing controller 240 further includes the overdrive region detecting unit 246 and the image data selecting unit 247 in addition to the configuration illustrated in FIG. 1. Further, the transmission device 100 and the timing controller 240 are connected to each other via the first transmission interface 141, the first transmission line 310, and the first receiving interface 251. The second transmission interface 142, the second transmission line 320, and the second receiving interface 252 are omitted.

Figure 4:
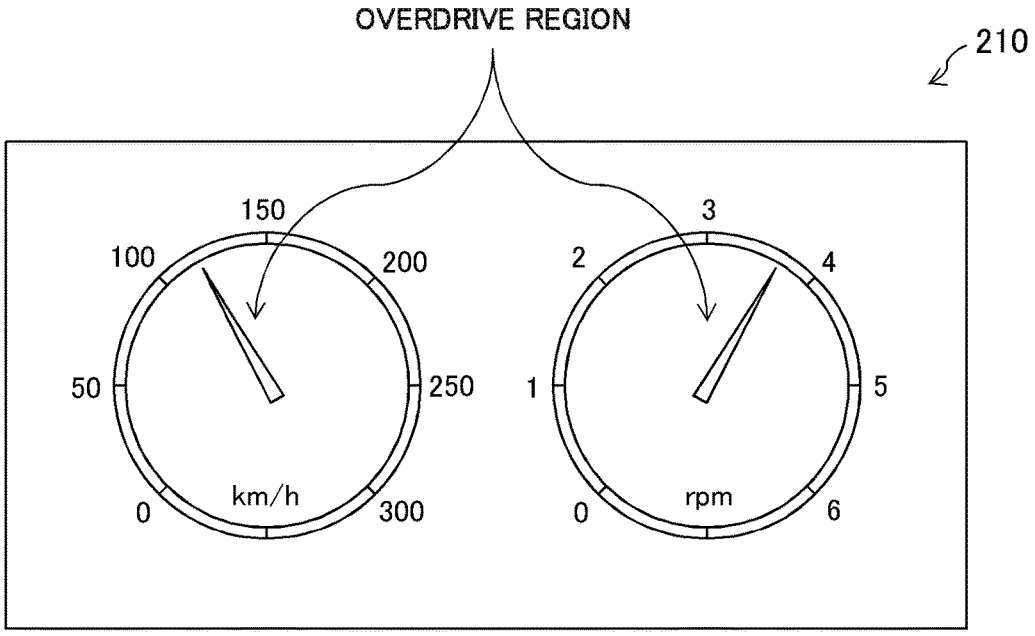
FIG. 4 is a plan view for illustrating an example of an in-vehicle panel.

The overdrive region specifying unit 150 is configured to, similarly to the configuration illustrated in FIG. 3, for example, output the coordinate information Pi representing the region of the meter needles of the speedometer and the tachometer (overdrive region) in the in-vehicle panel illustrated in FIG. 4 to the image data generating unit 110.

When the image data generating unit 110 acquires the coordinate information Pi from the overdrive region specifying unit 150, the image data generating unit 110 generates 8-bit image data including the previous frame data and the current frame data (overdrive frame data). For example, the image data generating unit 110 is configured to generate the image data (overdrive frame data) of the region corresponding to the coordinate information Pi (overdrive region) such that the previous frame data is allocated to the upper 4 bits of the 8 bits and the current frame data is allocated to the lower 4 bits thereof. For example, the image data generating unit 110 may be configured to generate the 4-bit frame data, and synthesize the 4-bit previous frame data and the 4-bit current frame data, to thereby generate the overdrive frame data. Further, the image data generating unit 110 may be configured to generate the 8-bit frame data, synthesize the upper 4 bits of the 8-bit previous frame data and the upper 4 bits of the 8-bit current frame data, and truncate the lower 4 bits of each frame data, to thereby generate the overdrive frame data.

Further, after the image data generating unit 110 generates the overdrive frame data including the 4-bit previous frame data and the 4-bit current frame data, the image data generating unit 110 embeds the coordinate information Pi in the vertical blanking period of the overdrive frame data to output the resultant data to the image data transmitting unit 130. Further, when the image data generating unit 110 does not receive the coordinate information Pi from the overdrive region specifying unit 150, the image data generating unit 110 generates the 8-bit current frame data to output the current frame data to the image data transmitting unit 130.

The image data transmitting unit 130 is configured to transmit overdrive frame data DEa including the coordinate information Pi, current frame data DEb, the vertical synchronizing signal VSYNC, and the horizontal synchronizing signal HSYNC to the timing controller 240 via the first transmission line 310.

The overdrive processing unit 243 is configured to receive the overdrive frame data DEa including the coordinate information Pi. The overdrive region detecting unit 246 is configured to detect the coordinate information Pi of the overdrive frame data DEa received by the overdrive processing unit 243. The overdrive region detecting unit 246 is configured to detect the coordinate information Pi to output the detection result to the computing unit 244 and the image data selecting unit 247. When the computing unit 244 acquires the coordinate information Pi from the overdrive region detecting unit 246, the computing unit 244 executes the overdrive processing for the region corresponding to the coordinate information Pi (overdrive region) based on the overdrive frame data DEa. Specifically, the computing unit 244 calculates the correction amount with reference to the LUT 245 based on the previous frame data in the upper 4 bits and the current frame data in the lower 4 bits in the 8-bit overdrive frame data DEa. The LUT 245 is configured to store the correction amounts set in advance so as to correspond to the combinations between the input grayscale of the 4-bit current frame data and the input grayscale of the 4-bit previous frame data. The computing unit 244 is configured to output the corrected frame data DEa' subjected to the overdrive processing to the image data selecting unit 247.

The image data selecting unit 247 is configured to receive the current frame data DEb transmitted from the transmission device 100, the detection result output from the overdrive region detecting unit 246, and the corrected frame data DEa' output from the computing unit 244. Then, the image data selecting unit 247 is configured to select the corrected frame data DEa' for the region corresponding to the coordinate information Pi (overdrive region) to output the corrected frame data DEa' to the image data transmitting unit 242, and select the current frame data DEb for the region other than the region corresponding to the coordinate information Pi to output the current frame data DEb to the image data transmitting unit 242. The image data transmitting unit 242 is configured to transmit the corrected frame data DEa' or the current frame data DEb to the data line driving circuit 230 as the display data DA based on the timing signal generated by the timing control unit 241.

In this case, the image data generating unit 110 may be configured to generate the overdrive frame data such that the previous frame data is allocated to the upper 3 bits of the 8 bits and the current frame data is allocated to the lower 5 bits thereof. With this, the number of grayscales in the current frame data is increased, and hence the grayscale characteristics of the display image based on the corrected frame data DEa' can be enhanced. Further, the image data generating unit 110 may be configured to thin the data of the lower 5 bits for the current frame data to use the thinned data as the upper 3 bits of the previous frame data at the next frame.

With the above-mentioned configuration, the overdrive image data for 2 frames can be formed with the same number of bits (for example, 8 bits) as the normal image data. Therefore, the transmission device 100 can transmit the overdrive image data by a pair of transmission and receiving interfaces and one transmission line without increasing the transfer speed of the image data. Therefore, the entire configuration of the display system 1 can be simplified, and the cost of the display system 1 can be reduced. Note that, the above-mentioned overdrive processing illustrated in FIG. 6 is suitable to be applied to a region that does not adversely affect the visibility even when the number of display grayscales is small, such as the instrument cluster image in the in-vehicle panel. Further, the display panel 210 is not limited to the in-vehicle panel, and various display panels configured to display an image are applicable.

Further, the display system 1 illustrated in FIG. 6 may include the temperature detecting unit 248 illustrated in FIG. 5. In this case, depending on the detected temperature, in the overdrive frame data, the number of bits for allocation between the previous frame data and the current frame data may be changed. For example, when the detected temperature is the room temperature, all of the 8 bits may be allocated to the current frame data to realize the 512 grayscales (the overdrive processing is not executed), and when the detected temperature is equal to or lower than the predetermined temperature, the 8 bits may be allocated to data of the current frame and the previous frame, to thereby execute the overdrive processing.

While there have been described what are at present considered to be certain embodiments of the application, it will be understood that various modifications may be made thereto, and it is intended that the appended claims cover all such modifications as fall within the true spirit and scope of the invention.

What is claimed is:

1. A display system, comprising:

a display device configured to display an image; and a transmission device configured to simultaneously transmit, to the display device, first image data of a first frame and second image data of a second frame that is one frame before the first frame, the display device comprising:

an overdrive processing unit configured to receive the first image data and the second image data transmitted from the transmission device, and to execute overdrive processing on the first image data based on the received first image data and the received second image data, to thereby generate display data;

a display panel configured to display an image based on the display data generated by the overdrive processing unit;

wherein the transmission device is configured to generate overdrive image data of (A+B) bits such that the second image data is allocated to A bits and the first image data is allocated to B bits, to thereby transmit the generated overdrive image data to the display device, wherein the overdrive processing unit is configured to execute the overdrive processing on the first image data based on the second image data and the first image data;

wherein the overdrive image data of (A+B) bits is set to satisfy A<B; and wherein A and B are both integers.

2. The display system according system according to claim 1, wherein the display panel comprises an in-vehicle panel installed on a vehicle, and wherein the overdrive image data corresponds to an instrument cluster image of the in-vehicle panel.

3. The display system according to claim 1, wherein the transmission device further comprises a specifying unit configured to specify an overdrive region, and wherein the transmission device is configured to:

transmit, for the overdrive region specified by the specifying unit, the first image data and the second image data simultaneously to the display device; and transmit, for a region other than the overdrive region, the first image data to the display device.

4. The display system according to claim 1, wherein the transmission device further comprises a first transmission interface and a second transmission interface, wherein the display device further comprises a first receiving interface and a second receiving interface, wherein the display system further comprises a first transmission line configured to connect the first transmission interface and the first receiving interface to each other, and a second transmission line configured to connect the second transmission interface and the second receiving interface to each other, and wherein the transmission device is configured to transmit the first image data to the display device via the first transmission line, and to transmit the second image data to the display device via the second transmission line.

5. A display system, comprising:

a display device configured to display an image; and a transmission device configured to transmit, to the display device, first image data of a first frame and second image data of a second frame that is one frame before the first frame, the display device comprising:

an overdrive processing unit configured to receive the first image data and the second image data transmitted from the transmission device, and to execute overdrive processing on the first image data based on the received first image data and the received second image data, to thereby generate display data; and a display panel configured to display an image based on the display data generated by the overdrive processing unit, the transmission device further comprising a first transmission interface, the display device further comprising a first receiving interface, the display system further comprising a first transmission line configured to connect the first transmission interface and the first receiving interface to each other, the transmission device being configured to, when the overdrive processing is not executed, transmit the first image data to the display device via the first transmission line at a first transfer speed, and when the overdrive processing is executed, transmit the first image data and the second image data to the display device via the first transmission line at a transfer speed twice as high as the first transfer speed.

6. A transmission device, which is configured to transmit image data to a display device, the transmission device being configured to simultaneously transmit, to the display device, first image data of a first frame and second image data of a second frame that is one frame before the first frame;

wherein the transmission device is configured to generate overdrive image data of (A+B) bits such that the second image data is allocated to A bits and the first image data is allocated to B bits, to thereby transmit the generated overdrive image data to the display device, wherein the overdrive image data of (A+B) bits is set to satisfy A<B; and wherein A and B are both integers.

7. The transmission device according to claim 6, wherein the transmission device is configured to:

transmit, for a region having low grayscale characteristics, the overdrive image data of (A+B) bits to the display device; and transmit, for a region having high grayscale characteristics, the first image data of (A+B) bits to the display device.

* * * * *